United States Patent [19]

Garrison

[11] 3,938,222

[45] Feb. 17, 1976

[54] TRACKING GUIDE FOR PLANETARY COILER

[75] Inventor: Joe Kent Garrison, Piedmont, S.C.

[73] Assignee: John D. Hollingsworth on Wheels, Inc., Greenville, S.C.

[22] Filed: Oct. 7, 1974

[21] Appl. No.: 512,450

[52] U.S. Cl. ..... 19/159 R

[51] Int. Cl.[2] ..... B65H 54/76

[58] Field of Search ..... 19/157, 159 R, 159 A; 28/21; 242/82, 83

[56] References Cited

UNITED STATES PATENTS

| | | | |
|---|---|---|---|
| 3,320,642 | 5/1967 | Fronza et al. | 19/159 R |
| 3,337,923 | 8/1967 | Whitehurst | 19/157 X |

OTHER PUBLICATIONS

Japanese Pat. No. 44–25646, published Oct. 29–69, 242–282, (Densen).

*Primary Examiner*—Dorsey Newton

*Attorney, Agent, or Firm*—Bailey & Dority

[57] ABSTRACT

A tracking device is illustrated wherein a rotatable guide is moved in a path approximating the path of the trumpet or other coiler sliver guide means responsive to suitable gearing and wherein the rotatable guide has a scalloped surface over which the sliver is fed for minimizing contact between the sliver and the rotatable guide and producing positive rotation of the rotatable guide by the sliver, avoiding sliding friction therebetween.

3 Claims, 4 Drawing Figures

TRACKING GUIDE FOR PLANETARY COILER

This invention relates to a tracking device for use with a planetary coiler, employing a rotatable guide for minimizing variations in tension exerted upon the sliver which tend to cause thick and thin places therein. By passing the sliver over a rotatable guide, friction is avoided and since the rotatable guide is itself moved together with the trumpet, variations in tension are further avoided. Moreover, the rotatable guide is provided with the scalloped surface over which the sliver is fed, minimizing contact and facilitating a positive drive therebetween in order to avoid sliding friction as tends to attenuate the sliver due to the unevenness inherent in such frictional engagement.

BACKGROUND OF THE INVENTION

Planetary coilers of the type illustrated in U.S. Pat. No. 3,355,775, are customarily provided with fixed guides such as eyelets or yokes through and over which sliver is fed to the trumpet of the coiler head and thence to the coiler calender rolls for delivery in a predetermined pattern into a sliver can. It has been found that a buildup often occurs on the eyelets and the like and that there are irregular variations in tension produced in the sliver due to the irregular nature of the frictional contact between the sliver and the eyelet. If the fiber is cotton, a sticky substance known as honeydew collects on the eyelets, and if the fiber is synthetic, a gummy finish buildup accumulates causing the fibers to hang up due to uneven friction interfering with the free flow of fibers over the guides. Moreover, static electricity is often generated by the contact between the sliver and such guide members disorienting the carded fibers.

Accordingly, it is an important object of the present invention to eleminate the point of frictional drag between the sliver and the eyelets and the like with a wheel or rotatable guiding element.

It has been further discovered that due to the variation in distance between the constantly moving trumpet and the fixed eyelet and the like, that tension variations occur as a result. These variations in tension would, of course, reflect in the sliver and subsequently produce yarn in the form of thick and thin places. It is another important object of the invention, therefore, to provide a tracking mechanism permitting the rotatable guide member to follow fairly closely the arcuate path of the trumpet as occurs in connection with a planetary coiler.

SUMMARY OF THE INVENTION

It has been found that a rotatable guide or roll member may be provided for use with a planetary coiler for guiding the sliver thereover so as to minimize frictional contact and at the same time track and closely follow the arcuate movement of the trumpet of the planetary coiler as it moves about the coiler head. The rotatable guide is provided with a scalloped surface minimizing contact between the sliver and the guide but affording a positive drive to avoid frictional engagement thereof by the sliver. The tracking motion is accomplished by suitable gearing including sun and planetary gears for maintaining an arm which carries the rotatable guide facing in the same direction while being translated in an arcuate path.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein; wherein.

DESCRIPTION OF A PREFERRED EMBODIMENT

The drawings illustrate a tracking device for delivering sliver to a planetary coiler, having coiler sliver guide means movable in a predetermined arcuate path responsive to drive means, for delivering sliver in a predetermined pattern for collection in a sliver can. The tracking device includes a rotatable guide A over which the sliver is fed for delivery to the sliver guide means. A vertical standard B is driven for rotation by the drive means. A horizontal offset arm C is carried adjacent a top of the standard. Means D are provided for mounting the rotatable element A on the arm C for rotation on a horizontal axis in substantial alignment with the sliver and above and in substantial alignment with the sliver guide means. Gear means E are driven by the vertical standard B moving the means D mounting the rotatable guide in a path following the arcuate path of the coiler sliver guide means. Thus, substantially even tension is exerted at all times on said sliver, avoiding attenuation thereof as would cause thin places in the sliver since the sliver is fed over a rotatable guide avoiding friction, and since the rotatable guide itself is moved with the coiler sliver guide means.

The invention is described in connection with a planetary coiler of the type illustrated in U.S. Pat. No. 3,355,775, the disclosure of which is incorporated herein and made a part hereof by reference. While the invention is thus described in connection with a coiler of a specific design which has a stationary can, it is to be understood that the tracking and guiding device hereof may be utilized in connection with coilers of other types and designs wherein the devices hereof are applicable.

Figure 1:
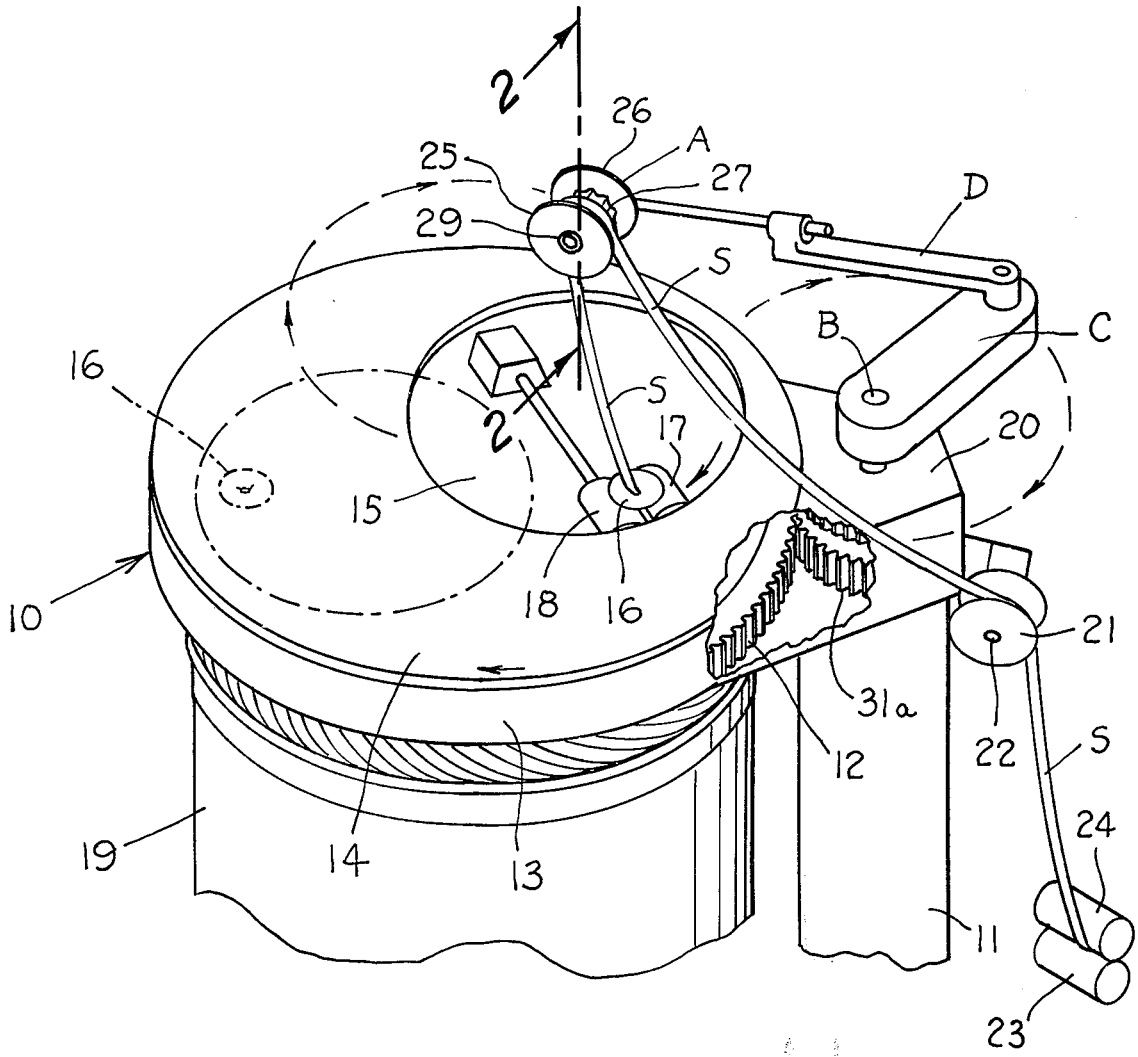
FIG. 1 is a schematic, perspective view illustrating a tracking sliver guiding device constructed in accordance with the present invention operably positioned upon a planetary coiler.
Figure 2:
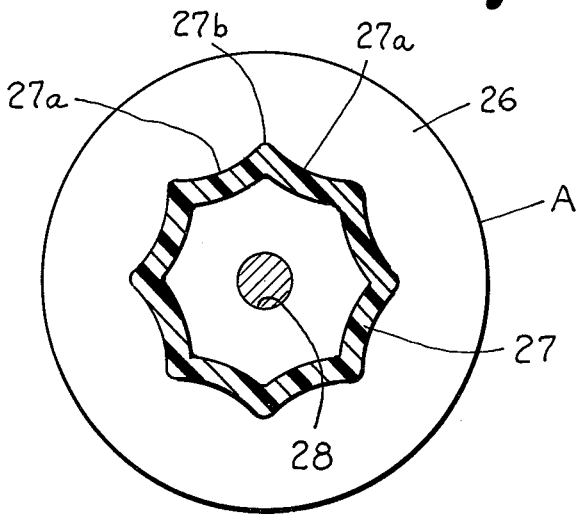
FIG. 2 is an enlarged longitudinal sectional elevation taken on the line 2—2 in FIG. 1.
Figure 3:
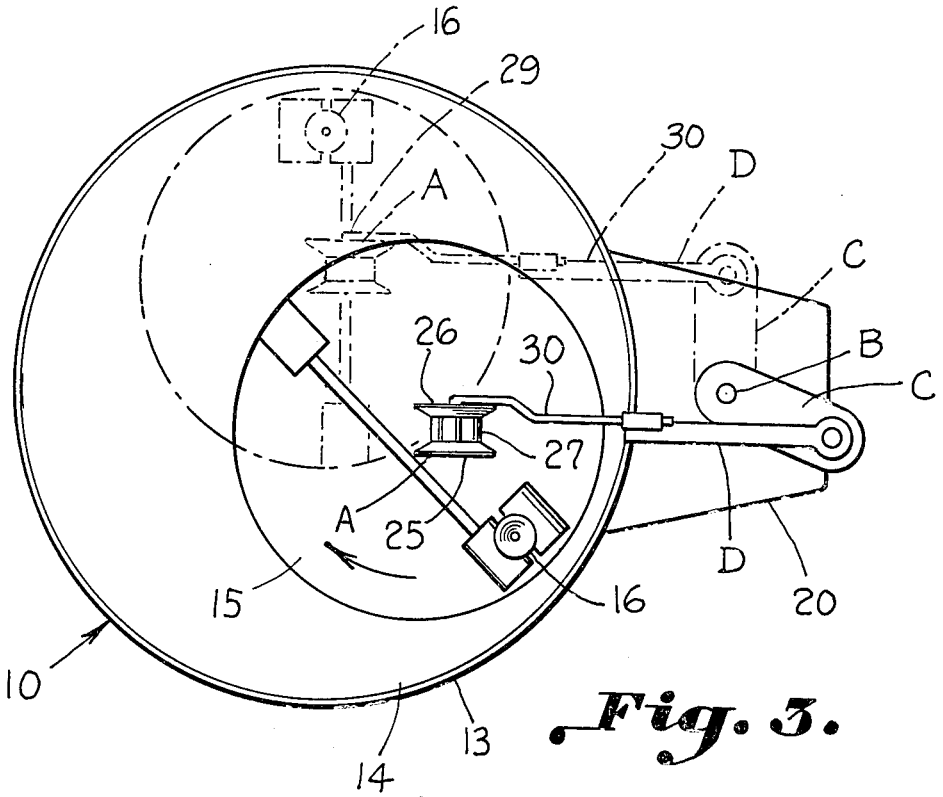
FIG. 3 is a top plan view further illustrating the sliver guide and tracking mechanism therefor constructed in accordance with the present invention.

A coiler head broadly designated at 10 is carried by a suitable vertical support 11 which carries suitable means for driving the ring or planetary gear 12 in a customary manner (not shown). The gear 12 is carried in a lower housing or support member 13 which forms a base of the coiler head. An upper support member 14 is carried adjacent the top of the base support member 13 and is driven for rotation in the direction of the arrows in FIG. 1 and 3. A second upper support member 15 is carried thereby and has a coiler sliver guide means in the form of a trumpet 16 carried therein. The trumpet moves with the support 15 in the direction of the arrow and is carried above the driven coiler calender rolls 17 and 18 which move together with the first and second upper supports 14 and 15 for delivering a sliver S (FIG. 1) to the sliver can 19. The vertical support 11 carries a housing 20 adjacent the top thereof and a sheave 21 is carried for rotation on a fixed stub shaft 22 adjacent the housing 20. The sliver S is illustrated in FIG. 1 as being delivered from a pair of calender rolls 23 and 24 of a carding machine.

The sliver is pulled over the sheave 21, guided over a rotatable guide A, and thence to a trumpet 16 and between the calender rolls 17 and 18. The rotatable guide or roll A is illustrated in the form of a sheave constructed preferably of plastic and molded in a single piece. The sheave or rotatable guide A has a pair of spaced flange members 25 and 27 bridged by a scalloped surface 27 over which the sliver S is fed. The scalloped surface 27 has spaced valleys or base portions 27*a* which carry triangular toothed-like projections 27*b* therebetween. The rotatable guide A has a cylindrical opening 28 therein for reception of a stub shaft 29 carried at right angles to a substantially horizontal rod 30. If desired, the sheave 21 may also be provided with a scalloped surface over which the sliver may pass.

Figure 4:
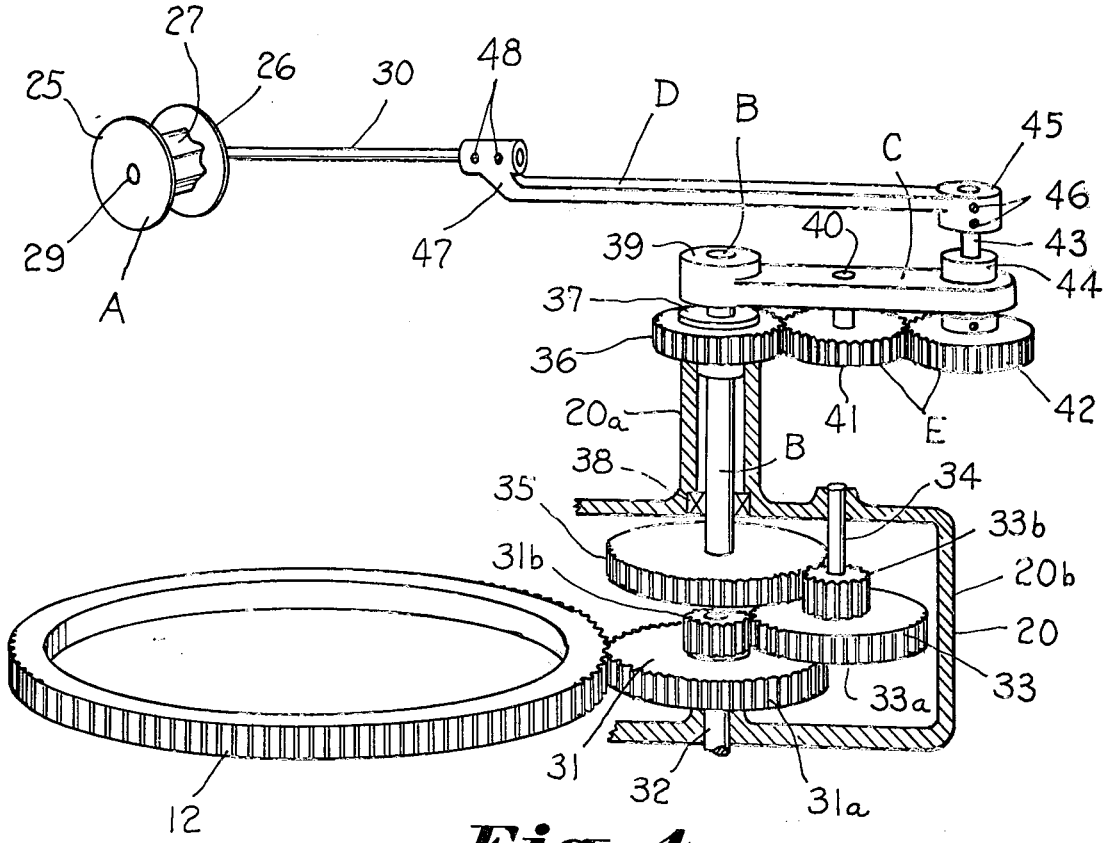
FIG. 4 is a schematic, perspective diagram of the gearing and linkage mechanism constituting a tracking mechanism constructed in accordance with the present invention.

A vertical standard B is carried in a vertical housing portion 20*a* of the housing 20. A suitable gear train carried in a lower portion 20*b* of the housing 20 is driven from the intermediate gear 12 (FIG. 4). A suitable compound gear 31 is journaled for rotation in the housing 20 upon a suitable stub shaft 32. The lower gear mechanism 31*a* of the compound gear 31 is driven by the external teeth of the gear 12. The upper portion 31*b* of the compound gear 31 drives a second compound gear 33 by engaging a lower gear portion 33*a* thereof. The compound gear 33 is carried for rotation upon the shaft 34 which depends from an upper portion of the lower housing 20*b*. The upper gear portion 33*b* of the compound gear 33 drives a gear 35 fixedly carried by the lower portion of the vertical standard or shaft B. A sun gear 36 is fixed upon the vertical housing portion 20*a* and a flanged thrust bearing 37 supports the vertical standard B for rotation therein. A suitable bearing 38 is provided adjacent the lower portion of the vertical housing 20*a* also supporting the vertical standard B for rotation therein.

The arm C is horizontally carried and offset from the standard B and is fixedly carried thereon as by the collar 39. The arm C has a stub shaft 40 depending therefrom for carrying gear means E for moving the mounting means D in an arcuate path but maintaining the means D facing always substantially in the same direction. The stub shaft 40 supports a planetary gear 41 which drives a planetary gear 42. The planetary gear 42 is carried by a shaft 43 which is carried in a bearing 44 adjacent the free end of the arm C. The means D mounting the rotatable element include a collar portion

45 fixed as by set screws 46 to the shaft 43. The means D adjacent the other end include a fitting 47 which carries the rod 30 fixed therein by means of set screws 48 passing therethrough.

While a preferred embodiment of the invention has been described using specific terms, such description is for illustrative purposes only, and it is to be understood that changes and variations may be made without departing from the spirit or scope of the following claims.

What is claimed is:

1. A tracking device for delivering sliver to a planetary coiler, having drive means, and coiler sliver guide means movable in a predetermined arcuate path responsive to said drive means, for delivering sliver in a predetermined pattern for collection in a sliver can comprising:

a rotatable guide over which said sliver is fed for delivery to said coiler sliver guide means;

a vertical standard driven for rotation by said drive means;

a horizontal offset arm carried adjacent a top of said standard;

means mounting said rotatable guide on said arm for rotation on a horizontal axis in substantial alignment with said sliver and above and in substantial alignment with said coiler sliver guide means; and gear means driven by said vertical standard moving said means mounting said rotatable guide in a path approximating the arcuate path of said coiler sliver guide means;

whereby substantially even tension is exerted at all times on said sliver avoiding attenuation thereof causing thin places in the sliver.

2. The structure set forth in claim 1, wherein said gear means includes a fixed sun gear and a pair of planetary gears carried by said arm, one of said planetary gears being fixed with respect to said means mounting said rotatable guide.

3. A tracking device for delivering sliver to a planetary coiler, having trumpet and the like movable by a planetary gear in a predetermined arcuate path for delivering sliver in a predetermiined pattern for collection in a sliver can comprising:

a guide over which said sliver is fed for delivery to said trumpet;

a vertical standard driven for rotation by said planetary gear;

an offset arm carried adjacent a top of said standard;

means mounting said guide on said arm in substantial alignment with said sliver and above and in substantial alignment with said trumpet; and gear means driven by said vertical standard moving said means mounting said guide in a path approximating the arcuate path of said trumpet;

whereby substantially even tension is exerted at all times on said sliver avoiding attenuation thereof causing thin places in the sliver.

* * * * *